US009054472B2

(12) United States Patent
Chen

(10) Patent No.: US 9,054,472 B2
(45) Date of Patent: Jun. 9, 2015

(54) POWER ADAPTER WITH PLUG MEMBER STOWABLE IN HOUSING

(71) Applicant: HON HAI PRECISION INDUSTRY CO., LTD., New Taipei (TW)

(72) Inventor: Wei-Hsi Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/037,390

(22) Filed: Sep. 26, 2013

(65) Prior Publication Data

US 2014/0295682 A1 Oct. 2, 2014

(30) Foreign Application Priority Data

Apr. 2, 2013 (TW) ..... 102206053

(51) Int. Cl.
*H01R 31/06* (2006.01)
*H01R 24/66* (2011.01)
*H01R 13/60* (2006.01)

(52) U.S. Cl.
CPC ..... *H01R 24/66* (2013.01); *H01R 13/60* (2013.01); *H01R 31/06* (2013.01)

(58) Field of Classification Search
CPC ..... H01R 31/06
USPC ..... 439/171, 172, 173
See application file for complete search history.

(56) References Cited

U.S. PATENT DOCUMENTS 4,973,827 A * 11/1990 Nozaki ..... 219/521
5,613,863 A * 3/1997 Klaus et al. ..... 439/131
5,634,806 A * 6/1997 Hahn ..... 439/173
5,684,689 A * 11/1997 Hahn ..... 363/146
5,848,907 A * 12/1998 Chen ..... 439/172
5,934,921 A * 8/1999 Doong ..... 439/172
6,109,977 A * 8/2000 Baxter et al. ..... 439/693
6,227,888 B1 * 5/2001 Hahn ..... 439/173
6,261,109 B1 * 7/2001 Liu et al. ..... 439/131
6,328,581 B1 * 12/2001 Lee et al. ..... 439/106
6,544,058 B1 * 4/2003 Chang ..... 439/173
6,592,386 B2 * 7/2003 Teng et al. ..... 439/172
6,659,782 B2 * 12/2003 Wu ..... 439/131
6,669,495 B2 * 12/2003 Philips et al. ..... 439/170
6,699,052 B1 * 3/2004 Poran ..... 439/172
6,923,667 B1 * 8/2005 Chen ..... 439/172
6,942,508 B2 * 9/2005 Wong ..... 439/171
6,988,903 B1 * 1/2006 Cheng ..... 439/137
7,008,246 B2 * 3/2006 Zhuge ..... 439/173
7,168,968 B1 * 1/2007 Li ..... 439/172
7,168,969 B1 * 1/2007 Wang ..... 439/173
7,179,105 B1 * 2/2007 Hung ..... 439/172

(Continued)

FOREIGN PATENT DOCUMENTS

CN 200820046726.9 2/2009
CN 201020129685.7 1/2011

*Primary Examiner* — Ross Gushi

(74) *Attorney, Agent, or Firm* — Novak Druce Connolly Bove + Quigg LLP

(57) ABSTRACT

An exemplary power adapter includes a plug member and a housing. The plug member includes a base and a pair of conductive pins located on the base. A number of protrusions protrude from a side of the base. The housing includes a receiving space for receiving the conductive pins. A receiving slot is located on the sidewall of the receiving space. A number of guiding cutouts extends from a top surface of the housing. The guiding cutouts are in communication with the receiving slot and the receiving space.

7 Claims, 7 Drawing Sheets

(56) References Cited

U.S. PATENT DOCUMENTS

| | | | | |
|---|---|---|---|---|
| 7,232,322 | B1 * | 6/2007 | Yen et al. | 439/222 |
| 7,264,492 | B2 * | 9/2007 | Liang | 439/171 |
| 7,265,517 | B2 * | 9/2007 | Bumiller | 320/114 |
| 7,300,297 | B1 * | 11/2007 | Wang | 439/173 |
| 7,381,059 | B2 * | 6/2008 | Wong | 439/22 |
| 7,439,709 | B2 * | 10/2008 | Bumiller | 320/114 |
| 7,547,219 | B2 * | 6/2009 | Zhuge | 439/173 |
| 7,597,570 | B2 * | 10/2009 | So | 439/172 |
| 7,601,023 | B1 * | 10/2009 | Ma et al. | 439/518 |
| 7,621,765 | B1 * | 11/2009 | Wu | 439/173 |
| 7,632,119 | B1 * | 12/2009 | Ma et al. | 439/172 |
| 7,632,137 | B1 * | 12/2009 | Ma et al. | 439/518 |
| 7,654,838 | B1 * | 2/2010 | Zhuge | 439/173 |
| 7,794,251 | B2 * | 9/2010 | Wen et al. | 439/173 |
| 7,806,727 | B2 * | 10/2010 | Dold et al. | 439/587 |
| 7,874,853 | B2 * | 1/2011 | Chiang et al. | 439/173 |
| 7,896,663 | B2 * | 3/2011 | Niidome et al. | 439/131 |
| 7,946,868 | B1 * | 5/2011 | Chen | 439/173 |
| 7,946,884 | B2 * | 5/2011 | Chiang et al. | 439/518 |
| 7,950,938 | B1 * | 5/2011 | Teoh | 439/171 |
| 8,033,847 | B1 * | 10/2011 | Chen | 439/172 |
| 8,052,441 | B2 * | 11/2011 | Senatori et al. | 439/171 |
| 8,079,877 | B1 * | 12/2011 | Lai et al. | 439/655 |
| 8,215,976 | B2 * | 7/2012 | Peng et al. | 439/345 |
| 8,226,424 | B1 * | 7/2012 | Wang et al. | 439/172 |
| 8,267,705 | B2 * | 9/2012 | Huang | 439/171 |
| 8,297,994 | B2 * | 10/2012 | Lee et al. | 439/172 |
| 8,313,335 | B2 * | 11/2012 | Wu | 439/172 |
| 8,382,526 | B2 * | 2/2013 | Chen et al. | 439/655 |
| 8,414,318 | B1 * | 4/2013 | Chen | 439/173 |
| 8,465,307 | B2 * | 6/2013 | Shieh et al. | 439/173 |
| 8,512,056 | B2 * | 8/2013 | Wen et al. | 439/172 |
| 8,579,656 | B2 * | 11/2013 | Huang | 439/518 |
| 8,608,502 | B2 * | 12/2013 | Witter et al. | 439/335 |
| 8,613,624 | B2 * | 12/2013 | Arenas et al. | 439/107 |
| 8,686,683 | B2 * | 4/2014 | Caskey et al. | 320/107 |
| 8,708,722 | B1 * | 4/2014 | Walliser et al. | 439/172 |
| 8,888,513 | B2 * | 11/2014 | Shi et al. | 439/131 |
| 8,936,490 | B2 * | 1/2015 | Hsu | 439/655 |
| 2002/0127898 | A1 * | 9/2002 | Liu | 439/131 |
| 2003/0228778 | A1 * | 12/2003 | Shang | 439/172 |
| 2004/0132328 | A1 * | 7/2004 | Wu | 439/172 |
| 2005/0136717 | A1 * | 6/2005 | Lai | 439/170 |
| 2005/0176281 | A1 * | 8/2005 | Zhuge | 439/173 |
| 2007/0032109 | A1 * | 2/2007 | Hung | 439/172 |
| 2007/0238341 | A1 * | 10/2007 | So | 439/172 |
| 2008/0064244 | A1 * | 3/2008 | Holland | 439/171 |
| 2010/0120278 | A1 * | 5/2010 | Yang | 439/171 |
| 2011/0143560 | A1 * | 6/2011 | Lee et al. | 439/108 |
| 2012/0021653 | A1 * | 1/2012 | Chen et al. | 439/655 |
| 2013/0157483 | A1 * | 6/2013 | Yu et al. | 439/131 |
| 2014/0295682 | A1 * | 10/2014 | Chen | 439/131 |

* cited by examiner

POWER ADAPTER WITH PLUG MEMBER STOWABLE IN HOUSING

BACKGROUND

1. Technical Field

The present disclosure relates to power adapters, and more particularly to a power adapter with a plug member that can be stowed in a housing of the power adapter.

2. Description of Related Art

For many kinds of electronic products, a power adapter is needed to supply power to the electronic product. Generally, the power adapter includes a housing and a plug member assembled to the housing, with conductive pins of the plug member exposed at an outside of the housing. With this structure, the conductive pins of the power adapter are prone to be accidentally damaged by other objects. In addition, the power adapter may not be sufficiently compact when it needs to be stored before its next use.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
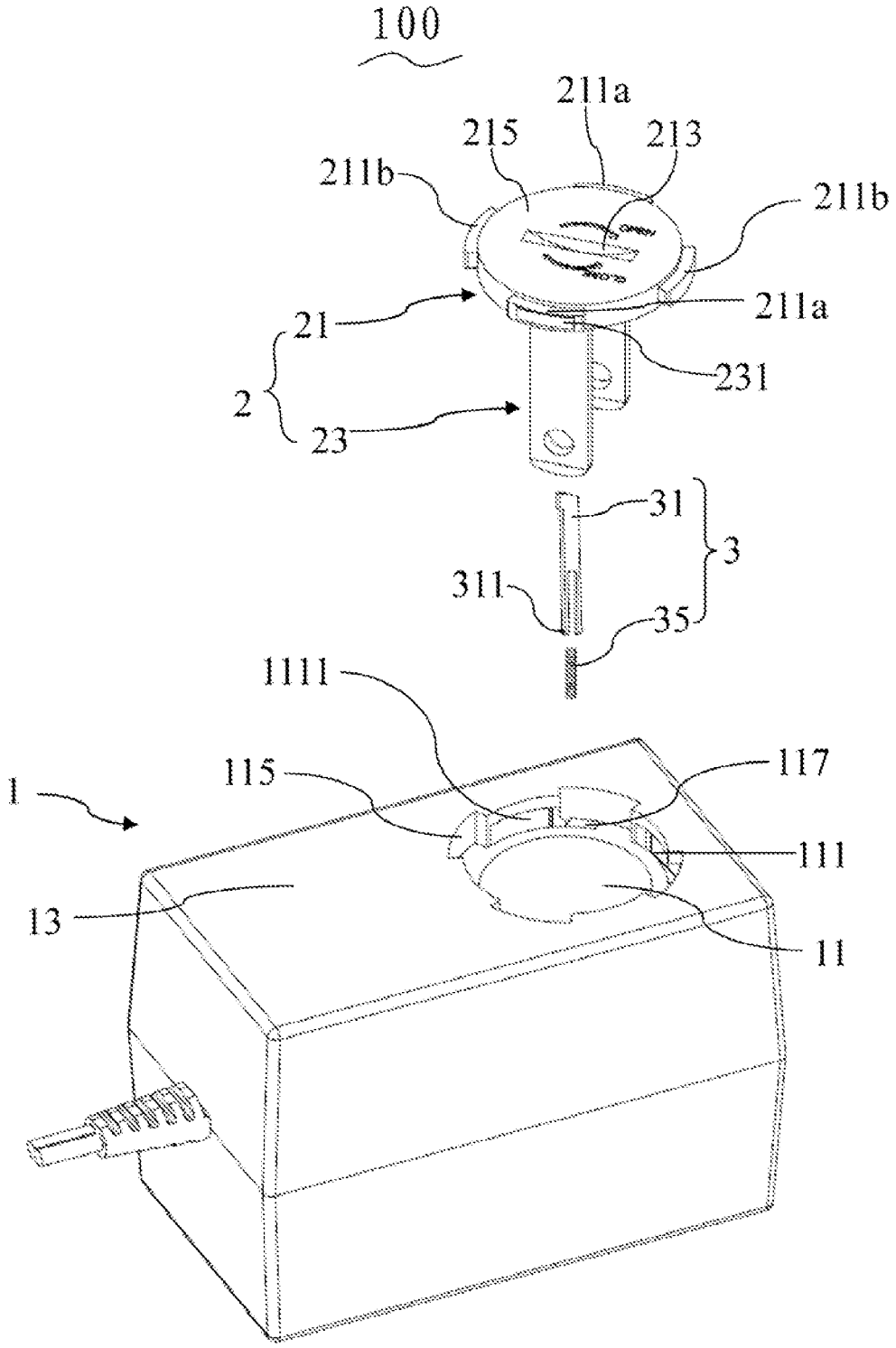
FIG. 1 is an exploded, perspective view of a power adapter according to an exemplary embodiment of the disclosure.

The disclosure is illustrated by way of example and not by way of limitation in the figures of the accompanying drawings in which like reference numerals indicate the same or similar elements. It should be noted that references to "an" or "one" embodiment in this disclosure are not necessarily to the same embodiment, and such references can mean "at least one."

Figure 3:
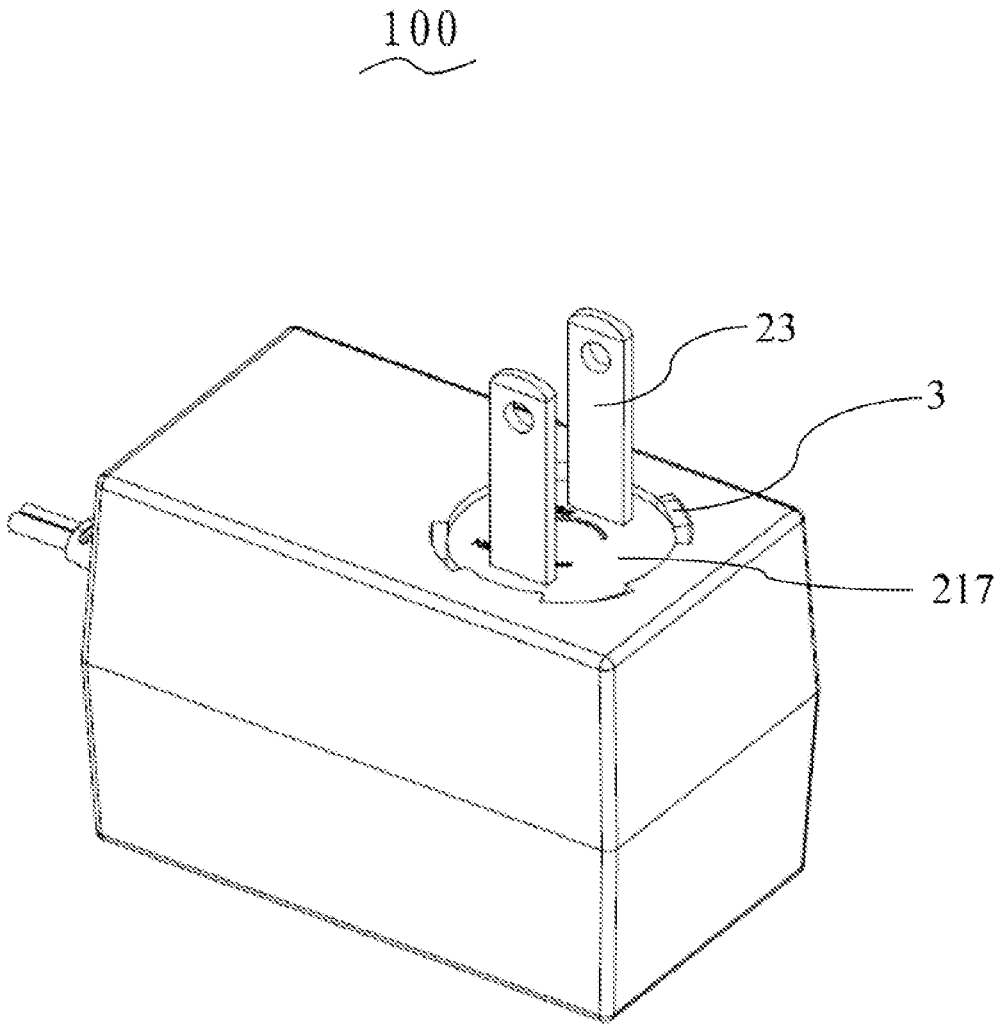
FIG. 3 is a perspective view of the power adapter of FIG. 1 when assembled ready for use.
Figure 5:
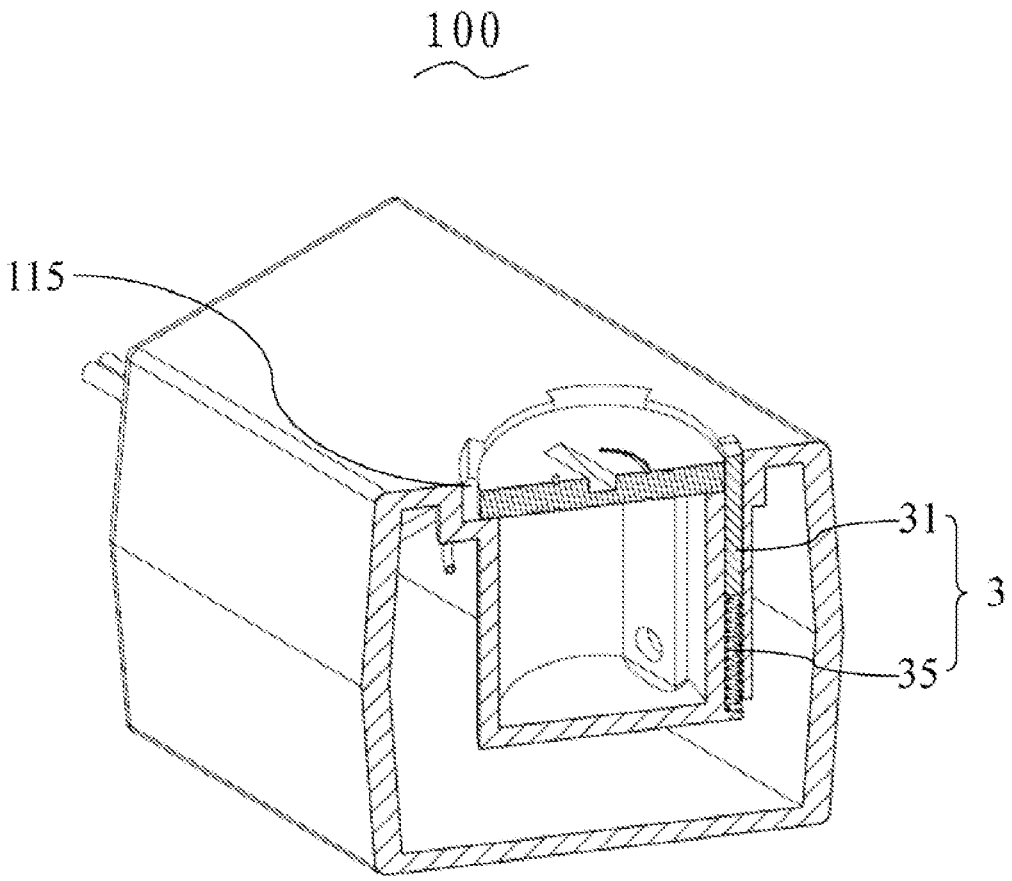
FIG. 5 is a perspective, cutaway view of the power adapter of FIG. 1 when assembled for compact storage until its next use.

FIG. 1 is an exploded, perspective view of a power adapter 100 according to an exemplary embodiment. The power adapter 100 comprises a housing 1, a plug member 2 and a spring-loaded latch 3. Referring also to FIG. 3, when the power adapter 100 works for supplying power to an electrical product, such as a mobile phone, the plug member 2 is exposed out of the housing 1 of the power adapter 100. In this state, electrically conductive pins 23 of the plug member 2 are exposed from the housing 1. Referring also to FIG. 5, when the power adapter 100 is not used, the plug member 2 is stowed substantially inside the housing 1 of the power adapter 100. In this state, the conductive pins 23 of the plug member 2 are received in the housing 1. The latch 3 is received in the housing 1, and is configured to prevent the plug member 2 from rotating in the housing 1 once the plug member 2 has been attached to the housing 1 in a desired position.

Figure 2:
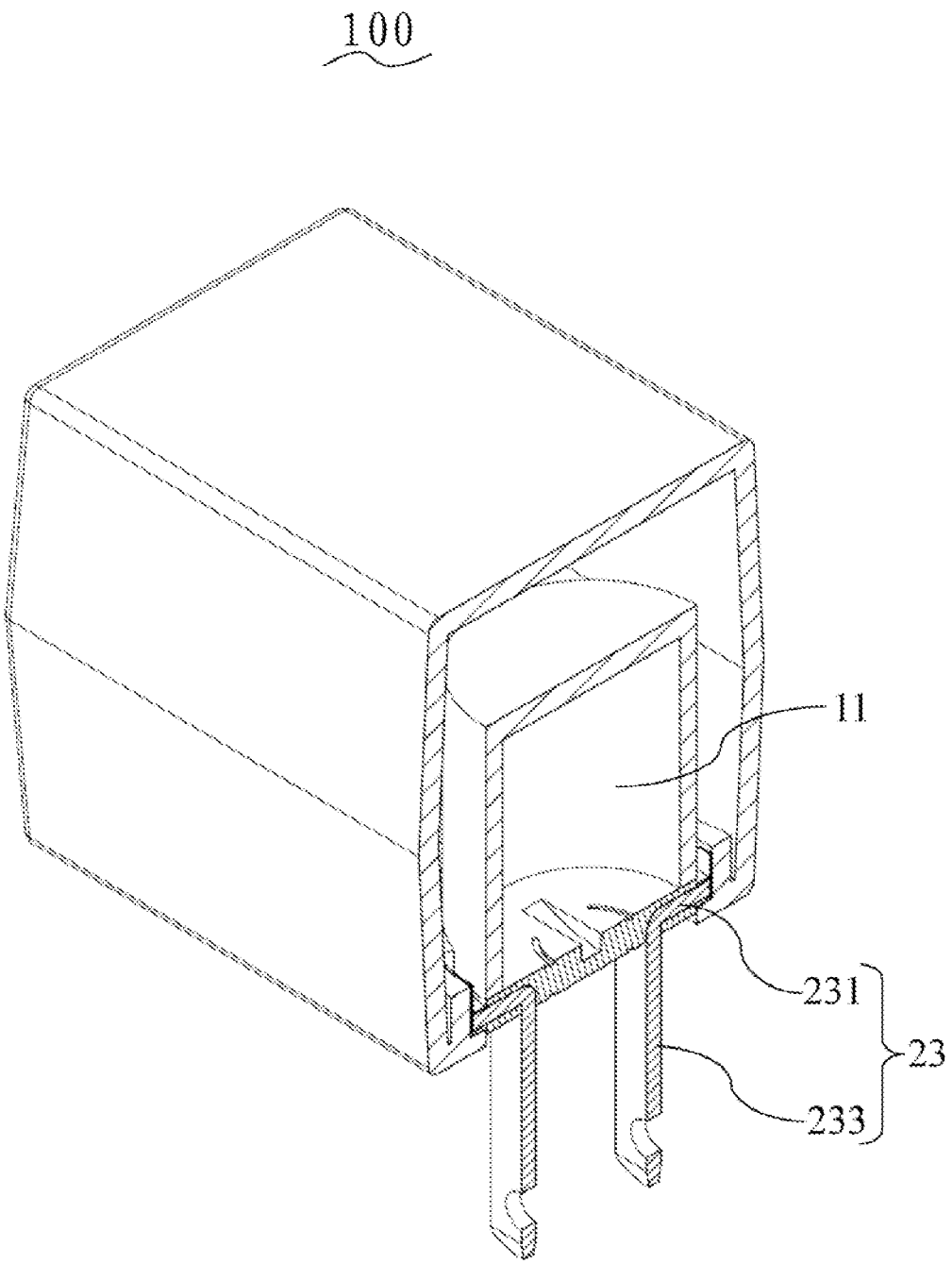
FIG. 2 is a perspective, cutaway view of the power adapter of FIG. 1 when assembled ready for use.
Figure 6:
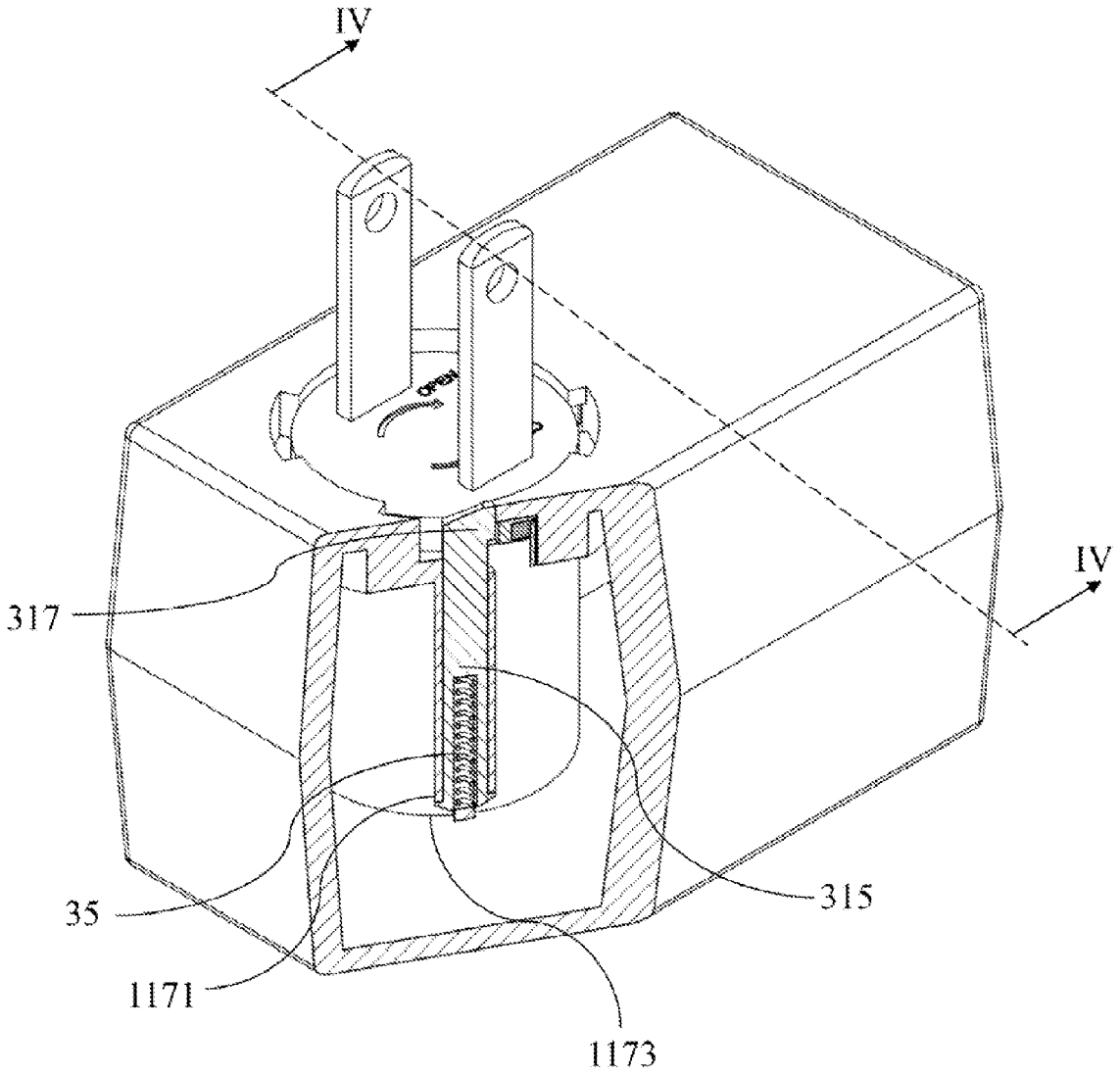
FIG. 6 is a cutaway view of the power adapter of FIG. 1 when assembled ready for use.

Referring also to FIGS. 2 and 6, the housing 1 defines a receiving space 11 for receiving the bulk of the plug member 2, a plurality of arc-shaped receiving slots 111 in communication with the receiving space 11, a plurality of guiding cutouts 115, and a vertical, elongate latch hole 117. In the illustrated embodiment, there are four receiving slots 111 and four guiding cutouts 115. The guiding cutouts 115 are in communication with the receiving slots 111, respectively, and are also in communication with the receiving space 11. The latch hole 117 is below and in communication with one of the guiding cutouts 115. The latch hole 117 has a uniform transverse cross-sectional area, except at a bottom where the latch hole 117 includes an enlarged portion. A wall of the latch hole 117 at the enlarged portion includes a stopper portion 1171 bordering a top of the enlarged portion. A bottom portion 1173 of the housing 1 borders a bottom of the enlarged portion of the latch hole 117. That is, the bottom portion 1173 serves as a bottom wall of the latch hole 117. The housing 1 comprises a plurality of electrically conductive strips 1111. In the embodiment, there are two conductive strips 1111.

Figure 4:
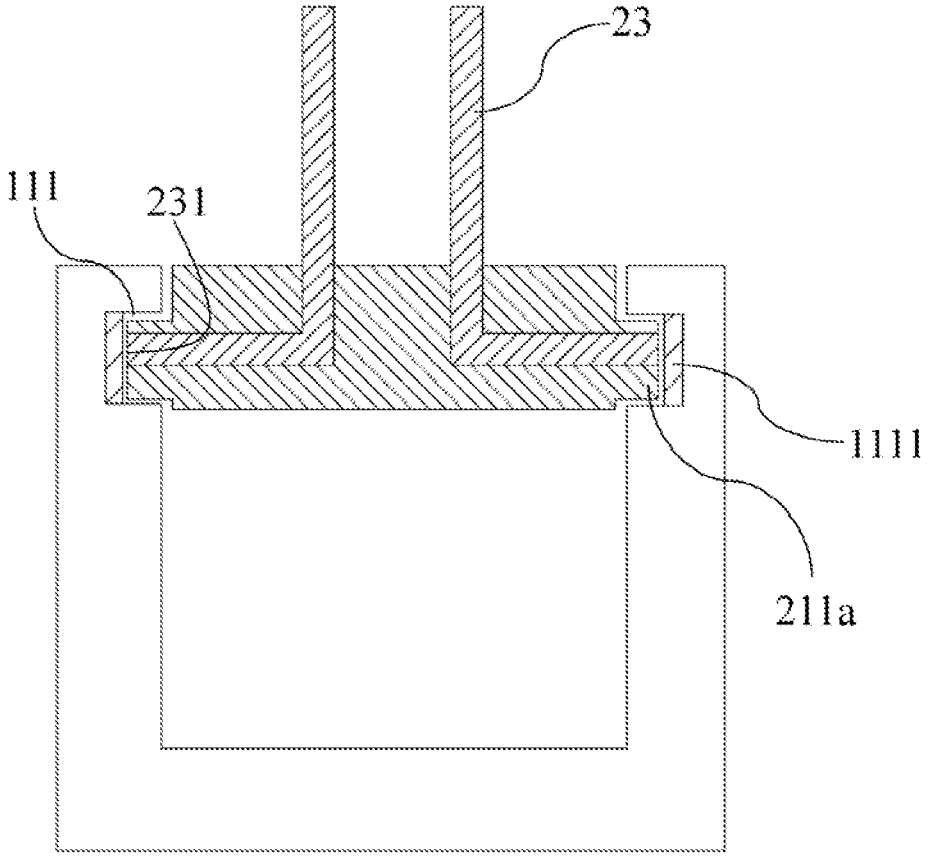
FIG. 4 is a cross-sectional view of the power adapter of FIG. 1 when assembled ready for use, corresponding to line IV-IV of FIG. 6.

The receiving space 11 is approximately in the shape of a cylinder. The receiving slots 111 are defined in an inner peripheral surface of the housing 1 near a top of the receiving space 11. An inner periphery of each receiving slot 111 communicates with the receiving space 11. Each guiding cutout 115 extends from a top surface 13 of the housing 1 down to a respective receiving slot 111. Bottom ends of the guiding cutouts 115 communicate with the receiving slots 111, and inner lateral sides of the guiding cutouts 115 communicate with the receiving space 11. Referring also to FIG. 4, the conductive strips 1111 are exposed on inner surfaces of two of the receiving slots 111, respectively, and are electrically connected with a printed circuit board (PCB, not shown) embedded in the housing 1.

FIGS. 1 and 3 show that the plug member 2 comprises a base 21, and the conductive pins 23 extending from a bottom portion 217 of the base 21. In alternative embodiments, there may for example be three conductive pins 23.

The base 21 is approximately disk-shaped, and has a top portion 215 opposite to the bottom portion 217. A plurality of protrusions 211 protrude from a circumferential side of the base 21. In the illustrated embodiment, there are four protrusions 211, which are equally angularly spaced from each other. An operating part 213 is provided in the top portion 215 of the base 21. In the embodiment, the operating part 213 is in the form of an elongate cutout. Alternatively, the operating part 213 may be in the form of a projection. With either of these structures, it is convenient for a user to operate the operating part 213 and rotate the base 21.

Referring also to FIG. 2, in the illustrated embodiment, the four protrusions 211 are divided into two pairs of protrusions 211, namely a pair of diametrically opposite first protrusions 211*a* and a pair of diametrically opposite second protrusions 211*b*. Alternatively, any two protrusions 211 can form the pair of first protrusions 211*a*, with the other two protrusions forming the pair of second protrusions 211*b*. In the illustrated embodiment, the first protrusions 211*a* correspond to the conductive pins 23. The second protrusions 211*b* are located between the first protrusions 211*a*, respectively. Each of the four protrusions 211 corresponds to one respective guiding cutout 115. In addition, the conductive strips 1111 of the housing 1 correspond to the conductive pins 23. In the embodiment, a first end 231 of each conductive pin 23 is embedded in the base 21 and is exposed out of an exterior surface of a lateral edge of a respective one of the first protrusions 211*a*. In addition, a second end 233 of each conductive pin 23 protrudes from the bottom portion 217 of the base 21, and is configured to plug into a socket such as an electrical mains socket (not shown). Referring also to FIG. 4, in assembly, the four protrusions 211 are received in the receiving slots 111, with the exposed portions of the conductive pins 23 electrically contacting the corresponding conductive strips 1111 to electrically connect with the PCB of the power adapter 100.

In the embodiment, the first protrusions 211*a* have different sizes, and the second protrusions 211*b* have the same size. The size of each of the first protrusions 211*a* is different from that of the second protrusions 211*b*. In particular, the size of one of the first protrusions 211*a* is less than that of the second protrusions 211*b*, and the size of the other first protrusion 211*a* is greater than that of the second protrusions 211*b*. The sizes of the two guiding cutouts 115 corresponding to the first protrusions 211a are substantially the same as those of the first protrusions 211*a*, respectively. The size of each of the two guiding cutouts 115 corresponding to the second protrusions 211*b* is substantially the same as that of each of the second protrusions 211*b*. With this structure, only the first protrusions 211*a* are insertable into the corresponding guiding cutouts 115, and the first protrusions 211*a* are insertable only in a correct orientation. This ensures that the first ends 231 of the conductive pins 23 electrically contact the correct conductive strips 1111.

Alternatively, the number of protrusions 211 and the number of guiding cutout 115 may be changed according to different requirements.

In assembly of the power adapter 100, the protrusions 211 are inserted into the guiding cutouts 115 so that the protrusions 211 are adjacent to ends of the receiving slots 111, respectively. Then the base 21 is turned in a clockwise direction (as viewed in FIGS. 1 and 3 for example), such that the protrusions 211 are engaged in the receiving slots 111 to attach the plug member 2 to the housing 1. If a user wants to disengage the plug member 2 from the housing 1, he/she turns the base 21 in a counterclockwise direction (as viewed in FIGS. 1 and 3 for example) to disengage the protrusions 211 from the receiving slots 111. Then the protrusions 211 are lifted out from the guiding cutouts 115. When the base 2 is fixed with the housing 1 for using the power adapter 100, the conductive pins 23 are exposed from the housing 1 for connection to a mating socket (not shown). When the base 2 is fixed with the housing 1 for the power adapter 100 to be stowed before its next use, the conductive pins 23 are received in the receiving space 11 of the housing 1. In this state, the conductive pins 23 are hidden in the housing 1, which protects the conductive pins 23 from damage and reduces a size of the power adapter 100.

With the above-described structure, the plug member 2 and the housing 1 are detachably assembled together. In addition, a user can conveniently utilize another different type of plug member 2 with the housing 1 according to practical requirements.

Figure 7:
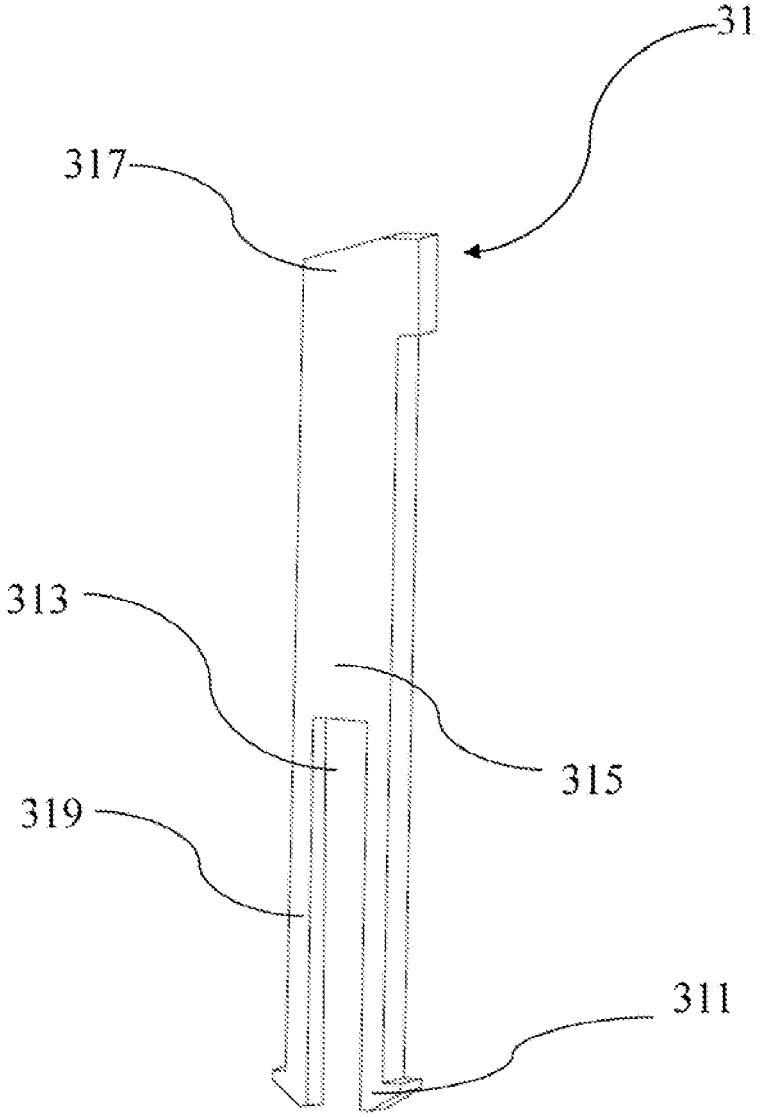
FIG. 7 is an enlarged, perspective view of a main body of a latch of the power adapter seen in FIG. 6.

FIG. 5 and FIG. 7 show that the latch 3 comprises a main body 31 and a spring 35. A lower portion 315 of the main body 31 extends into the latch hole 117. An upper portion 317 of the main body 31 is exposed out of the latch hole 117 and is located in the corresponding guiding cutout 115. In the embodiment, the lower portion 315 includes a pair of legs 319, and a groove 313 defined between the legs 319. The legs 319 extend down to a bottom of the latch 3. A pair of hooks 311 is formed at bottom ends of the legs 319, respectively. Referring also to FIG. 6, the spring 35 is received in the groove 313, and is resisted (e.g. compressed) between the bottom portion 1173 of the latch hole 117 and an edge of the lower portion 315 at the top end of the groove 313.

In assembly of the latch 3 in the housing 1, the lower portion 315 of the main body 31 having the spring 35 received in the groove 313 is extended into the latch hole 117. The hooks 311 are received between the stopper portion 1171 and the bottom portion 1173 of the latch hole 117. That is, the hooks 311 can vertically move between the bottom portion 1173 and the stopper portion 1171. When the hooks 311 are stopped on the stopper portion 1171, the upper portion 317 of the main body 31 extends out of the latch hole 117, to block the corresponding first protrusion 211*a* and thereby prevent the plug member 2 from rotating in the housing 1. When the upper portion 317 of the main body 31 retracts into the latch hole 117, the spring 35 is compressed and the hooks 311 move downward to the bottom portion 1173 of the latch hole 117.

With this structure, when the protrusions 211 of the base 21 are inserted into the guiding cutouts 115, the upper portion 317 of the main body 31 is pressed by the corresponding first protrusion 211*a* and retracts into the latch hole 117 with the spring 35 being compressed. Then the base 21 is turned, the protrusions 211 are received in the receiving slots 111, and the upper portion 317 of the main body 31 extends out of the latch hole 117 under urging force applied by the decompressing spring 35. As a result, the corresponding first protrusion 211*a* is blocked by the upper portion 317 of the main body 31, and the plug member 2 is firmly fixed with the housing 1.

When detaching the plug member 2 from the housing 1, a user's fingertip pushes the upper portion 317 of the main body 31 of the latch 3 down, so that the corresponding first protrusion 211*a* is no longer blocked. Then the base 21 is rotated counterclockwise to make the protrusions 211 slide out from the receiving slots 111. Finally, the protrusions 211 are lifted out from the guiding cutouts 115, to remove the plug member 2 from the housing 1.

Although various features and elements are described as embodiments in particular combinations, each feature or element can be used alone or in other various combinations within the principles of the present disclosure to the full extent indicated by the broad general meaning of the terms in which the appended claims are expressed.

What is claimed is:

1. A power adapter comprising:

a housing defining a receiving space, a plurality of receiving slots surrounding the receiving space and in communication with the receiving space, and a plurality of guiding cutouts, the guiding cutouts extending from a top surface of the housing, and the guiding cutouts in communication with the receiving space, and also in communication with the receiving slots, respectively; and a plug member comprising a base, a plurality of conductive pins protruding from a bottom portion of the base, and a plurality of protrusions protruding from a side of the base and corresponding to the guiding cutouts;

wherein the plug member is attachable to the housing in a selected one of a first orientation and a second orientation;

wherein when the plug member is attached to the housing in each of the first orientation and the second orientation, the protrusions of the base are inserted into the guiding cutouts, and the plug member is rotated until the protrusions are received in the receiving slots such that the protrusions are stopped in the receiving slots and the plug member is detachably fixed in the housing;

wherein when the plug member is attached to the housing in the first orientation, the conductive pins are exposed outside the housing; and wherein when the plug member is attached to the housing in the second orientation, the conductive pins are received in the receiving space.

2. The power adapter of claim 1, wherein the base comprises a top portion opposite to the bottom portion, and an operating part provided in the top portion.

3. The power adapter of claim 1, wherein the plug member comprises a pair of conductive pins, the housing comprises a pair of conductive strips corresponding to the conductive pins, the conductive strips are exposed on inner surfaces of two of the receiving slots, respectively, and one end of each conductive pin is embedded in the base and exposed out of an exterior surface of one of the protrusions to electrically contact a corresponding conductive strip when the plug member is attached to the housing in each of the first orientation and the second orientation.

4. The power adapter of claim 3, wherein the plurality of protrusions comprises a first pair of protrusions corresponding to the conductive pins, and a second pair of protrusions, and a size of each protrusion of the first pair of protrusions is different from a size of each protrusion of the second pair of protrusions.

5. The power adapter of claim 1, further comprising a spring-loaded latch, wherein the latch is movably received in the housing and configured to prevent the plug member from rotating in the housing upon the plug member being attached to the housing in each of the first orientation and the second orientation.

6. The power adapter of claim 5, wherein the housing further defines a latch hole in communication with one of the guiding cutouts, the latch comprises a main body and a spring, a lower portion of the main body is received in the latch hole, an upper portion of the main body is exposed out of the receiving slot, and the spring is resisted between a bottom wall of the latch hole and the lower portion of the main body.

7. The power adapter of claim 6, wherein the latch further comprises a pair of legs and a pair of hooks located at bottom ends of the legs, a groove is defined between the legs, the housing comprises a stopper portion above the bottom wall of the latch hole, the spring is received in the groove, and the hooks are stopped on the stopper portion under elastic urging by the spring.

* * * * *